US009786994B1

(12) United States Patent
Lee et al.

(10) Patent No.: US 9,786,994 B1
(45) Date of Patent: Oct. 10, 2017

(54) CO-LOCATED, MULTI-ELEMENT ANTENNA STRUCTURE

(71) Applicant: AMAZON TECHNOLOGIES, INC., Reno, NV (US)

(72) Inventors: Tzung-I Lee, San Jose, CA (US); Cheol Su Kim, San Jose, CA (US); In Chul Hyun, San Jose, CA (US)

(73) Assignee: Amazon Technologies, Inc., Reno, NV (US)

( * ) Notice: Subject to any disclaimer, the term of this patent is extended or adjusted under 35 U.S.C. 154(b) by 256 days.

(21) Appl. No.: 14/221,136

(22) Filed: Mar. 20, 2014

(51) Int. Cl.
*H01Q 21/00* (2006.01)
*H01Q 5/342* (2015.01)
*H01Q 25/04* (2006.01)

(52) U.S. Cl.
CPC ..... *H01Q 21/0006* (2013.01); *H01Q 5/342* (2015.01); *H01Q 25/04* (2013.01)

(58) Field of Classification Search
CPC ..... H01Q 21/0006; H01Q 5/342; H01Q 25/04
USPC ..... 343/702, 833, 834, 853
See application file for complete search history.

(56) References Cited

U.S. PATENT DOCUMENTS 6,476,769 B1 * 11/2002 Lehtola ..... H01Q 1/243 343/700 MS
7,973,726 B2 * 7/2011 Tseng ..... H01Q 1/243 343/700 MS
8,473,017 B2 * 6/2013 Milosavljevic ..... H01Q 1/241 343/702
8,803,756 B2 * 8/2014 Montgomery ..... H01Q 1/243 343/700 MS
8,854,268 B2 * 10/2014 Lin ..... H01Q 1/2266 343/702
9,406,999 B2 * 8/2016 Rappoport ..... H01Q 1/243
2005/0001769 A1 * 1/2005 Qi ..... H01Q 1/243 343/700 MS
2005/0275596 A1 * 12/2005 Harano ..... H01Q 1/243 343/702
2006/0214857 A1 * 9/2006 Ollikainen ..... H01Q 1/243 343/702
2007/0052497 A1 * 3/2007 Tada ..... H03H 3/0077 333/186

(Continued)

*Primary Examiner* — Dameon E Levi
*Assistant Examiner* — Ab Salam Alkassim, Jr.
(74) *Attorney, Agent, or Firm* — Lowenstein Sandler LLP

(57) ABSTRACT

Antenna structures and methods of operating the same of an electronic device are described. One apparatus includes a first radio frequency (RF) feed, a second RF feed and an antenna structure. The antenna structure includes a ground plane, a first antenna element coupled to the first RF feed, a second antenna element coupled to the second RF feed and coupled to the ground plane at a first grounding point located at a distal end of the second antenna element. The first antenna element operates as a first directly-fed element and the second antenna element operates as a first parasitic ground element when RF signals in a first frequency range are applied to the first RF feed. The second antenna element operates as a second directly-fed element when RF signals in a second frequency range are applied to the second RF feed, the second frequency range being higher than the first frequency range. The first antenna element is grounded by the RF short circuit when the RF signals in the second frequency range are applied to the second RF feed.

20 Claims, 10 Drawing Sheets

(56) References Cited

U.S. PATENT DOCUMENTS

| | | | | |
|---|---|---|---|---|
| 2008/0111746 | A1* | 5/2008 | Levy | G06F 1/1616 343/702 |
| 2009/0009401 | A1* | 1/2009 | Suzuki | H01Q 1/242 343/700 MS |
| 2012/0105286 | A1* | 5/2012 | Rhyu | H01Q 1/243 343/702 |
| 2012/0154222 | A1* | 6/2012 | Oh | H01Q 1/243 343/702 |
| 2012/0262343 | A1* | 10/2012 | Radojkovic | H01Q 9/42 343/702 |
| 2012/0274532 | A1* | 11/2012 | Kurashima | H01Q 1/243 343/833 |
| 2014/0266923 | A1* | 9/2014 | Zhou | H01Q 5/35 343/702 |
| 2015/0109169 | A1* | 4/2015 | Ko | H01Q 1/243 343/700 MS |

* cited by examiner

CO-LOCATED, MULTI-ELEMENT ANTENNA STRUCTURE

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops and the like. These electronic devices wirelessly communicate with a communications infrastructure to enable the consumption of the digital media items. In order to wirelessly communicate with other devices, these electronic devices include one or more antennas.

BRIEF DESCRIPTION OF THE DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
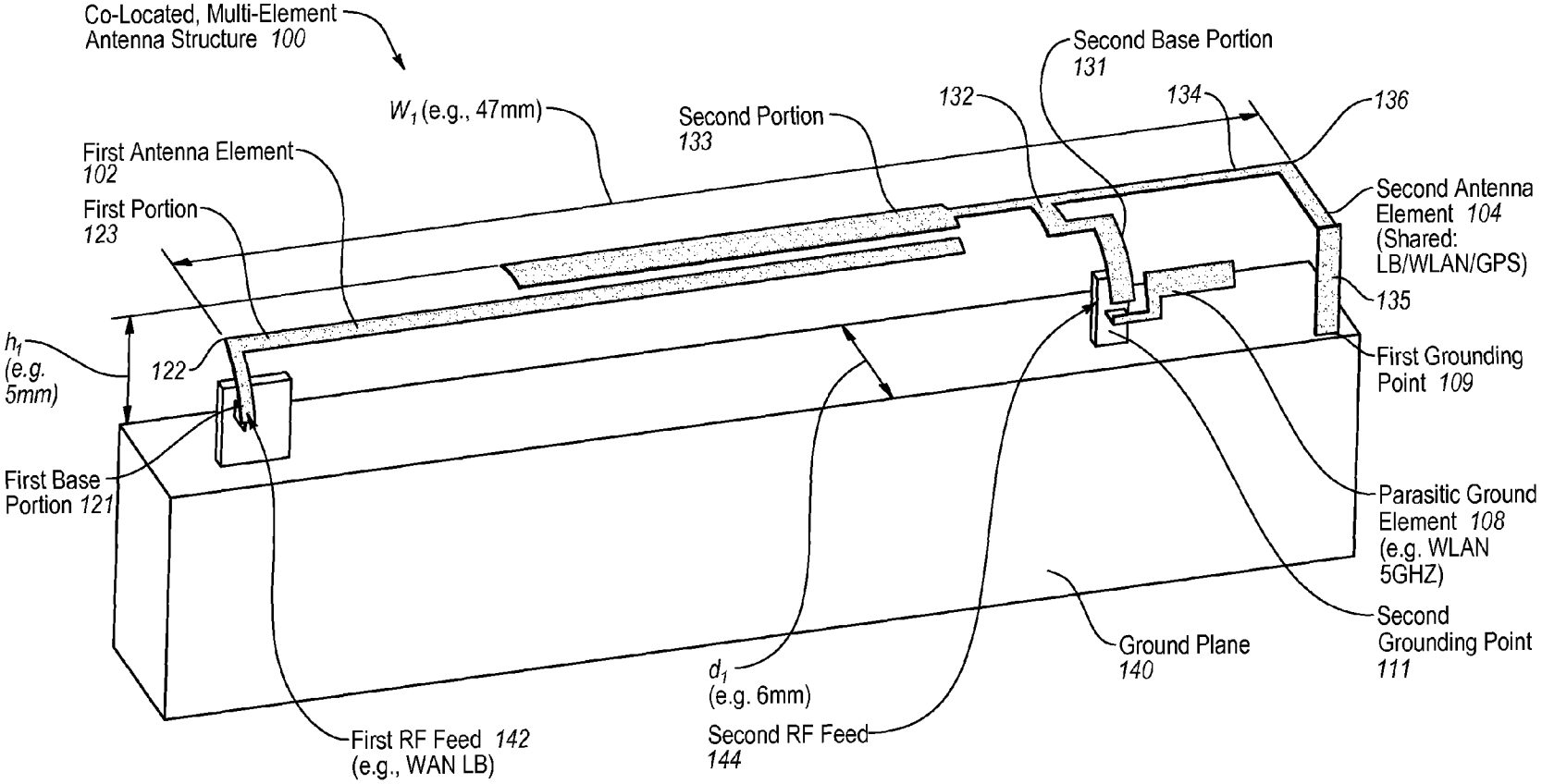
FIG. 1 is a perspective view of a co-located, multi-element antenna structure according to one embodiment.

Antenna structures and methods of operating the same of an electronic device are described. One apparatus includes a first radio frequency (RF) feed, a second RF feed and an antenna structure. The antenna structure includes a ground plane, a first antenna element coupled to the first RF feed, a second antenna element coupled to the second RF feed and coupled to the ground plane at a first grounding point located at a distal end of the second antenna element. The first antenna element operates as a first driven element and the second antenna element operates as a first parasitic ground element when the first RF feed is driven in a first frequency range. The second antenna element operates as a second driven element when the second RF feed is driven in a second frequency range, the second frequency range being higher than the first frequency range. The first antenna element is grounded by the RF short circuit when the second RF feed is driven in the second frequency range. The antenna structure can be used in a compact dual-feed configuration in various portable electronic devices, such as a tablet computer, mobile phones, personal data assistances, electronic readers (e-readers), or the like. In conventional dual-feed antenna structures for low-band and high-band, both bandwidth and efficiency in the high-band can be limited by the space availability and interference between the high-band antenna and the low-band antenna in a compact electronic device. Embodiments of the antenna structures described herein can be used to improve radiation efficiency in desired frequency bands, as well as increase isolation between the low-band antenna and the high-band antenna, reducing or eliminating interference between the low-band antenna and the high-band antenna. The co-located, multi-element antenna structure can be used for Long Term Evolution (LTE) frequency bands, third generation (3G) frequency bands, Wi-Fi® and Bluetooth® frequency bands or other wireless local area network (WLAN) frequency band, wide area network (WAN) frequency bands, global positioning system (GPS) frequency bands, or the like.

The electronic device (also referred to herein as user device) may be any content rendering device that includes a wireless modem for connecting the user device to a network. Examples of such electronic devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

One problem for antenna design engineers in user device is that it is difficult to design a single-feed, multi-band antenna for some compact user devices. In particular, small mobile devices typically need to support 4G LTE communications and dual-band Wi-Fi® multiple-input, multiple-output (MIMO) operation. However, it is difficult to design an antenna to support the various frequency ranges, including 699-960 MHz, 1.45-2.17 GHz, 2.3-2.7 GHz and 5 GHz to 6 GHz, in a compact device with space constraints. Another problem for antenna design engineers is that conventional multi-feed antenna designs suffer from performance issues. Closely spaced antennas suffer from low isolation and high interference between the multiple antennas of the multi-feed antenna design. The embodiments described herein are directed to a co-located, multi-element antenna structure that uses two feeds. The co-located, multi-element antenna structure uses two feeds, share common antenna elements to ease the antenna design, save space and to create high isolation between the two feeds. Driving one of the two feeds results in a first antenna radiating structure of the multiple antenna elements of the co-located, multi-element antenna structure, while driving the other one of the two feeds results in a second different antenna radiating structure of the multiple antenna elements. Thus, the co-located, multi-element antenna structure has separate antenna radiating structures for different frequencies. The embodiments described herein also can be configured to short circuit one of the RF feeds (low-band freed) at some frequencies (e.g., high frequencies such as the GPS band, Wi-Fi® 2.4 GHz and 5 GHz bands). The antenna structure is considered to be a co-located, multi-element antenna structure because at least portions of multiple antenna elements of the structure are disposed proximate to one another to form a coupling section between the multiple antenna elements. The coupling section may be a capacitive coupling or an inductive coupling. In some embodiments, the portions of the coupling section are disposed on a same plane. In other embodiments, the portions of the coupling section can be disposed on two or more planes when the co-located, multi-element antenna structure is a three-dimensional structure.

FIG. 1 is a perspective view of a co-located, multi-element antenna structure 100 according to one embodiment. The co-located, multi-element antenna structure 100 (hereinafter "antenna structure 100") can be disposed in an electronic device that includes circuitry that drives a first radiation frequency (RF) feed 142 and a second RF feed 144. In FIG. 1, the ground is represented as a radiation ground plane 140. The ground plane 140 may be a metal frame of the electronic device. The ground plane 140 may be a system ground or one of multiple grounds of the user device. The RF feeds 142, 144 may be a feed line connector that couples the antenna structure 100 to a respective transmission line of the electronic device. The RF feeds 142, 144 are each a physical connection that carries the RF signals to and/or from the antenna structure 100 and the circuitry of the electronic device. The feed line connector may be any one of the three common types of feed lines, including coaxial feed lines, twin-lead lines or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the antenna structure 100. In another embodiment, the feed line connection is connected to the co-located, multi-element antenna structure with one or more impedance matching networks. The first RF feed 142 is coupled to a first end of a first antenna element 102 of the antenna structure 100. In one embodiment, the first RF feed 142 is electrically coupled to an RF short circuit (not illustrated in FIG. 1), as described below with respect to FIGS. 3-4. The first antenna element 102 extends from the first RF feed 142 towards the second RF feed 144. The first antenna element 102 is not conductively coupled to the second RF feed 144. The second RF feed 144 is coupled to a second antenna element 104 of the antenna structure 100. The second antenna element 104 is coupled to the ground plane 140 at a first grounding point 109. The first antenna element 102 includes a first portion 123 that extends from the first RF feed 142 towards the second RF feed 144 and is not conductively coupled to the second antenna element 104. The first portion 123 is disposed to be parallel to a second portion 133 of the second antenna element 104 to closely couple the first antenna element 102 and the second antenna element 104. The first portion 123 and the second portion 133 are considered closely coupled because the first portion 123 is not conductively coupled to the second portion 133, but the proximity to one another, forms a coupling (e.g., capacitive or inductive) between the first portion 123 and the second portion 133 when radiating. In another embodiment, the first portion 123 and the second portion 133 can form other closely coupled structures, such as interdigitated structures, teeth structures, or the like.

In another embodiment, the antenna structure 100 further includes a third antenna element, labeled parasitic ground element 108. The parasitic ground element 108 is coupled to the ground plane 140 at a second grounding point 111. The second grounding point 111 is closer to the second RF feed 144 than the first grounding point 109. The proximity of the parasitic ground element 108 to the second RF feed 144 forms a coupling between the parasitic ground element 108 and the second antenna element 104. When driven by the second RF feed 144, the second antenna element 104 parasitically induces current on the parasitic ground element 108 that is coupled to the ground plane 140. Although there is a gap between the conductive traces, the parasitic ground element 108 is in close enough proximity to form a close coupling (also referred to herein as "coupling"), such as a capacitive coupling or an inductive coupling, between the parasitic ground element 108 and the second antenna element 104. The parasitic ground element 108 is an element of the antenna structure 100 that is not driven directly by the second RF feed 144. Rather, the second RF feed 144 directly drives another element of the antenna structure 100 (e.g., the second antenna element 104), which parasitically induces a current on the parasitic ground element 108. The other element is referred to as a directly-fed or driven element. In particular, by directly applying current on the other element by the second RF feed 144, the directly-fed element radiates electromagnetic energy, which induces another current on the parasitic ground element 108 to also radiate electromagnetic energy. In the depicted embodiment, the parasitic ground element 108 is parasitic because it is physically separated from the second antenna element 104, which is driven at the second RF feed 144, but the parasitic ground element 108 forms a coupling between the other antenna element(s). For example, the second antenna element 104 parasitically excites the current flow of the parasitic ground element 108. By coupling the driven element and the passive element, additional resonant modes can be created or existing resonant modes can be improved, such as decreasing the reflection coefficient or extending the bandwidth. The depicted antenna structure 100 can use multiple resonant modes to cover various frequency ranges. For example, the antenna structure 100 can be used in a compact device with space constraints to cover approximately 699 MHz to approximately 960 MHz, approximately 1.45 GHz to approximately 2.17 GHz, approximately 2.3 GHz to approximately 2.7 GHz and approximately 5 GHz to approximately 6 GHz. In other embodiments, additional resonant modes can be achieved.

In the depicted embodiment, the first antenna element 102 has an L-shape with a first base portion 121 that extends from the first RF feed 142 to a first junction 122 in a first direction and the first portion 123 that extends from the first junction 122 in a second direction. The second antenna element 104 has a T-shape, including a second base portion 131 that extends from the second RF feed 144 to a second junction 132 in the first direction; the second portion that extends from the second base portion 131 in a third direction; a third portion 134 that extends from the second junction 132 in the second direction towards a third junction 136; and a fourth portion 135 that extends from the third junction 136 to the first grounding point 109 in a fourth direction. In this embodiment, the second direction and the third direction are perpendicular to the first direction and the fourth direction is parallel to the first direction. In one embodiment, the first portion 123 is parallel to the second portion 133 for a specified distance to create a coupling between the first antenna element 102 and the second antenna element 104. It should be noted that a "junction" or "fold" refers to a bend, a corner or other change in direction of the antenna element. For example, the junction may be where one segment of an antenna element changes direction in the same plane or in a different plane. Typically, junctions or folds in antennas can be used to fit the entire length of the antenna within a smaller area or smaller volume of a user device. The antenna structure 100 can be formed by using one or more conductive traces on a printed circuit board, metal traces disposed on the antenna carrier, or the like.

In another embodiment, the antenna structure includes the ground plane 140, a first antenna element coupled to a first RF feed, a second antenna element coupled to a second RF feed and coupled to the ground plane. The second antenna element is coupled to ground plane at a first grounding point located at a distal end of the second antenna element. The distal end being the farthest from the second RF feed. The first antenna element operates as a first driven element and the second antenna element operates as a first parasitic ground element when the first RF feed is driven in a first frequency range. The second antenna element operates as a second driven element when the second RF feed is driven in a second frequency range, the second frequency range being higher than the first frequency range. The first antenna element is grounded by the RF short circuit when the second RF feed is driven in the second frequency range. The first RF feed can be configured to operate as an RF short when the second RF feed is driven, as described herein.

In a further embodiment, the antenna structure further includes a third antenna element coupled to the ground plane at a second grounding point nearer to the second RF feed than the first grounding point. The third antenna element operates as a second parasitic ground element when the second RF feed is driven in the second frequency range.

In another embodiment, the first antenna element extends from the first RF feed towards the second RF feed. The first antenna element is not conductively coupled to the second RF feed. The first antenna element includes a first portion that extends from the first RF feed towards the second RF feed and is not conductively coupled to the second antenna element. The first portion is disposed to be parallel to a second portion of the second antenna element to closely couple the first antenna element and the second antenna element.

The antenna structure 100 radiates electromagnetic energy in multiple resonant modes. The first antenna element 102 and the second antenna element 104 radiate electromagnetic energy in a first resonant mode when the first RF feed 142 is driven in a low-band (e.g., a frequency range between approximately 699 MHz to approximately 960 MHz). The first antenna element 102, second antenna element 104, and parasitic ground element 108 (third antenna element) radiate electromagnetic energy in at least two resonant modes when the second RF feed 144 is driven in one or more bands higher than the low-band (e.g., one or more frequency ranges). The two or more resonant modes may cover a second frequency range that includes multiple sub-ranges. For example, in one embodiment, the second frequency range includes a first sub-range between approximately 1.565 GHz to approximately 1.605 GHz; a second sub-range between approximately 2.4 GHz to approximately 2.5 GHz; and a third sub-range between approximately 5 GHz to approximately 6 GHz.

In a further embodiment, the second antenna element 104 operates as a second parasitic ground element when the first RF feed 142 is driven in a low-band. The second antenna element 104 operates as a driven element when the second RF feed 144 is driven in one or more bands higher than the low-band. In some embodiments, the first RF feed 142 includes a RF short tank that operates to ground the first RF feed 142 when the second RF feed 144 is driven in one or more bands higher than the low-band. Grounding the first RF feed 142 may increase higher isolation between the first RF feed 142 and the second RF feed 144 at certain frequencies. For example, a RF short can be configured to increase the isolation between the first RF feed 142 and the second RF feed 144 at an operating frequency in the high-band. The antenna structure 100 has common elements that operate as separate antenna radiating structures when RF signals are separately applied to the two RF feeds 142, 144.

In one embodiment, antenna structure 100 is disposed on an antenna carrier (not illustrated), such as a dielectric carrier of the electronic device. The antenna carrier may be any non-conductive material, such as dielectric material, upon which the conductive material of the antenna structure 100 can be disposed without making electrical contact with other metal of the electronic device. In another embodiment, the antenna structure 100 is disposed on, within, or in connection with a circuit board, such as a printed circuit board (PCB). In one embodiment, the ground plane 140 may be a metal chassis of a circuit board. Alternatively, the antenna structure 100 may be disposed on other components of the electronic device or within the electronic device as would be appreciated by one of ordinary skill in the art having the benefit of this disclosure. It should be noted that the antenna structure 100 illustrated in FIG. 1 is a three-dimensional (3D) structure. However, as described herein, antenna structure 100 may include two-dimensional (2D) structures, as well as other variations than those depicted in FIG. 1.

In some embodiments, the antenna elements of the antenna structure 100 may be disposed on one side of an antenna carrier. In other embodiments, the antenna elements of the antenna structure 100 can be folded two or more sides of the antenna carrier. In one embodiment, the portions of the first antenna element 102, second antenna element and parasitic ground element 108 are disposed on two sides of the antenna carrier, such as a front side and a top side of the antenna carrier. This can be done to fit the antenna structure 100 in a smaller volume while maintaining the overall length of the antenna elements. The embodiments of the antenna structure 100 can be used in compact devices with space constraints. For example, in one embodiment, the antenna structure 100 fits within a volume of 5 mm height (h1), 47 mm width (w1) and 6 mm depth (d1). This volume can still accommodate additional components of the device. In other embodiments, smaller or larger volumes can be used.

In one embodiment, the first RF feed 142 is a WAN LB feed, the second RF feed 144 is a WLAN/GPS feed, the first antenna element 102 is a WAN LB antenna (e.g., approximately 699 MHz to approximately 960 MHz), the second antenna element 104 is a WLAN/GPS antenna (e.g., approximately 1.565 GHz to approximately 1.605 GHz and approximately 2.4 GHz to approximately 2.5 GHz), and the parasitic ground element 108 is a WLAN antenna (e.g., approximately 5 GHz to approximately 6 GHz). The second antenna element 104 can operate as a shared element or common element when driven in the LB mode (LB signals applied to the LB feed) and in the HB mode (HB signals applied to the HB feed) as illustrated and described below with respect to current flows of FIG. 2. For example, the second antenna element 104 can operate a shared element for LB, WLAN, and GPS operations. The parasitic ground element 108 can operates as a shared element for LB, WLAN and GPS as well. Also, during WLAN and GPS operation, the first antenna element 102 can be grounded by the RF short circuit. This may create additional isolation between the two RF feeds 142, 144, as well as reduce interference between the two RF feeds 142, 144.

The dimensions of the antenna structure 100 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another. The antenna structure 100 may have various dimensions based on the various design factors. The first antenna element 102 has a first effective length that is roughly the distance between the first RF feed 142 along the conductive trace(s). In one embodiment, the antenna structure 100 has an overall height ($h_1$), an overall width ($W_1$), and an overall depth ($d_1$). The overall height ($h_1$) may vary, but, in one embodiment, is about 5 mm. The overall width ($W_1$) may vary, but, in one embodiment, is about 47 mm. The overall depth ($d_4$) may vary, but, in one embodiment, is about 6 mm. Alternatively, other dimensions may be used for the antenna structure 100.

In a further embodiment, as illustrated in FIG. 1, the second portion 133 of the second antenna element 104 can be considered an extension area that is wider than other portions of the second antenna element 104. The extension area is coupled to a distal end of the second antenna element 104, the distal end being an end farthest from the second RF feed 144. The extension area may contribute to an effective length (or width) of the second antenna element 104. The extension area can be shortened or lengthened to tune the resonance frequencies of the resonant modes of the second RF feed 144. The extension area can be used to contribute to impedance matching, as well as to increase the close coupling with the first antenna element 102. In another embodiment, the antenna structure 100 may include one or more additional arms, slots (not illustrated) or notches (not illustrated) for one or more additional resonant modes.

In this embodiment, the antenna structure 100 is a 3D structure as illustrated in the perspective view of FIG. 1. In other embodiments, the first antenna element 102 and second antenna element 104 are 3D structures that wrap around different sides of the antenna carrier and the parasitic ground element 108 is a 2D structure disposed on a front side of the antenna carrier. Of course, other variations of layout may be used for the first antenna element 102, second antenna element 104 and the parasitic ground element 108. It should also be noted that various shapes for the antenna structure 100 are possible. For example, the antenna structure 100 can have various bends, such as to accommodate placement of other components, such as a speakers, microphones, USB ports.

As described herein, strong resonances are not easily achieved within a compact space within user devices, especially within the spaces on smart phones and tablets. The structure of the antenna structure 100 of FIG. 1 provides strong resonances at designated frequencies as described herein and can share common elements for different frequencies. These resonances can be operated in separate modes or may be operated simultaneously. These multiple strong resonances can provide an improved antenna design as compared to conventional designs. In one embodiment, the antenna structure 100 illustrated in FIG. 1 is configured to radiate electromagnetic energy in a first frequency range (e.g., low-band) and one or more second frequency ranges (e.g., high-band). The second frequency range is higher than the first frequency range. In one embodiment, the antenna structure 100 can operate between approximately 699 MHz to approximately 960 MHz in the first frequency range and in one or more sub-ranges in the second frequency range. The sub-ranges may be, for example, between approximately 1.565 GHz to approximately 1.605 GHz, approximately 2.4 GHz to approximately 2.5 GHz and approximately 5 GHz to approximately 6 GHz. In another embodiment, the parasitic ground element 108 can be configured to radiate electromagnetic energy at approximately 3 GHz. For example, the length of the parasitic ground element 108 can be increased to support 3 GHz band. The embodiments described herein are not limited to use in these frequency ranges, but could be used to increase the bandwidth of a multi-band frequency in other frequency ranges, as described herein. The antenna structure may be configured to operate in multiple resonant modes. For example, in another embodiment, the antenna structure may include one or more additional arm elements, slot antennas in the antenna structure or notches to create one or more additional resonant modes. In another embodiment, the antenna structure may include additional elements, such as a parasitic ground element (e.g., a monopole that extends from the ground plane that couples to the other antenna elements), to create an additional resonant mode. The embodiments described herein are not limited to use in these frequency ranges, but could be used to increase the bandwidth of a multi-band frequency in other frequency ranges, such as for operating in one or more of the following frequency bands Long Term Evolution (LTE) 700, LTE 2700, Universal Mobile Telecommunications System (UMTS) (also referred to as Wideband Code Division Multiple Access (WCDMA)) and Global System for Mobile Communications (GSM) 850, GSM 900, GSM 1800 (also referred to as Digital Cellular Service (DCS) 1800) and GSM 1900 (also referred to as Personal Communication Service (PCS) 1900). The antenna structure may be configured to operate in multiple resonant modes. References to operating in one or more resonant modes indicates that the characteristics of the antenna structure, such as length, position, width, proximity to other elements, ground, or the like, decrease a reflection coefficient at certain frequencies to create the one or more resonant modes as would be appreciated by one of ordinary skill in the art. Also, some of these characteristics can be modified to tune the frequency response at those resonant modes, such as to extend the bandwidth, increase the return loss, decrease the reflection coefficient, or the like. The embodiments described herein also provide a dual-feed antenna in a size that is conducive to being used in a user device.

Figure 2:
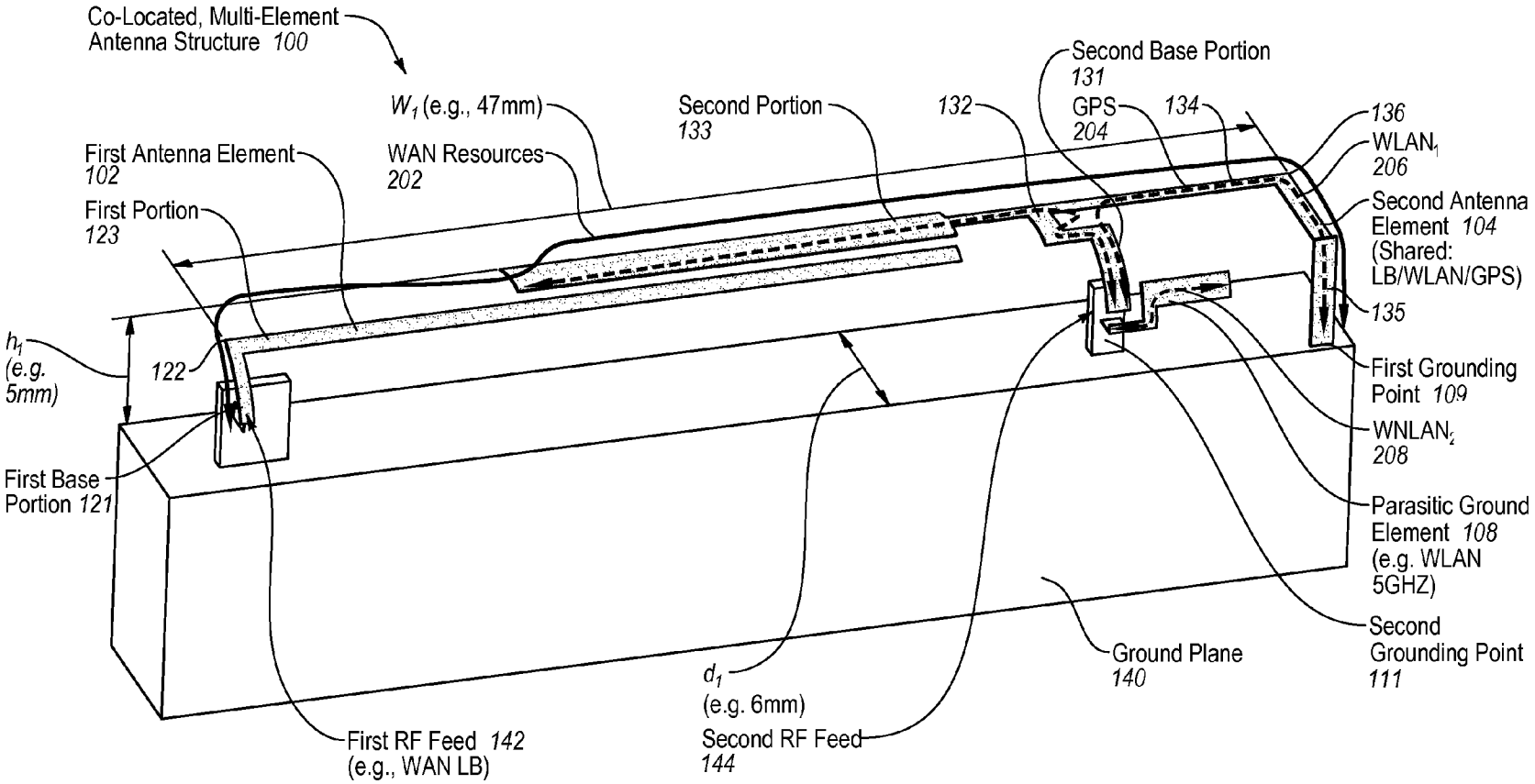
FIG. 2 illustrates current flow of the co-located, multi-element antenna structure of FIG. 1 according to one embodiment.

FIG. 2 illustrates current flow of the antenna structure 100 of FIG. 1 according to one embodiment. In a first mode in which RF signals are applied to the first RF feed 142 in a low band (e.g., RF signals in a first frequency range), the first antenna element 102 and the second antenna element 104 radiate electromagnetic energy in a low-band resonance, WAN resonance 202. The WAN resonance 202 is created by a current flow to or from the first RF feed 142 to the first grounding point 109. The first portion 123 and the second portion 133 form a close coupling between the first antenna element 102 and the second antenna element 104 to permit the current flow to extend beyond the first antenna element 102 to portions of the second antenna element 104 along its path to the first grounding point 109. In a second mode in which RF signals are applied to the second RF feed 144 in one or more higher bands than the low-band (e.g., RF signals in one or more frequency ranges higher than the first frequency range), the first antenna element 102, second antenna element 104 and parasitic ground element 108 radiate electromagnetic energy in at least two resonant modes, including a GPS resonance 204, a first WLAN resonance 206 ($WLAN_1$) and a second WLAN resonance 208 ($WLAN_2$). FIG. 2 illustrates how the co-located, multi-element antenna structure has separate antenna radiating structures for different frequencies. This permits a simpler antenna design and a more compact antenna design than conventional single-feed and two-feed designs. As described in more detail below, during the second mode of operation, the first RF feed 142 can be shorted for operation in the higher frequencies to create more isolation between the first RF feed 142 and the second RF feed 144.

In another embodiment, when RF signals are applied to the first RF feed 142, the first antenna element 102 parasitically induces current on the second antenna element 104 (and possibly on the parasitic ground element 108) that is coupled to the ground plane 140. Although there is a gap between the conductive traces, the second antenna element 104 is in close enough proximity to form a close coupling (also referred to herein as "coupling") with the first antenna element, such as a capacitive coupling or an inductive coupling, between the first antenna element 102 and second antenna element 104. Because the second antenna element 104 is coupled to the ground plane 140 at the first grounding point 109, the second antenna element 104 operates as a parasitic ground element that is not driven directly by the first RF feed 142 during a first mode. That is RF signals are not directly applied to the second antenna element 104, but currents are parasitically induced on the second antenna element 104. The first RF feed 142 directly drives another element of the antenna structure 100 (e.g., the first antenna element 102), which parasitically induces a current on the second antenna element 104, which is coupled to the ground plane 140 at a distal end, the distal end being the farthest from the second RF feed 144. In particular, by directly applying current on the other element (also referred to as a driven element or directly-fed element) by the first RF feed 142, the directly-fed element radiates electromagnetic energy, which induces another current on the second antenna element 104 to also radiate electromagnetic energy. In the depicted embodiment, the parasitic ground element 108 is physically separated from the first antenna element 102 and the second antenna element 104, but the parasitic ground element 108 forms a coupling between these antenna elements. By coupling the first antenna element 102 and the second antenna element 104, additional resonant modes can be created or existing resonant modes can be improved, such as decreasing the reflection coefficient or extending the bandwidth. The depicted antenna structure 100 can use two or more resonant modes to cover various frequency ranges as described herein.

In another embodiment, a tunable element (not illustrated) is coupled between the second grounding point 111 (or the first grounding point 109) where the parasitic ground element 108 is coupled to the ground plane 140. The tunable element can be used to tune the resonant frequency of the parasitic ground element 108.

Figure 3:
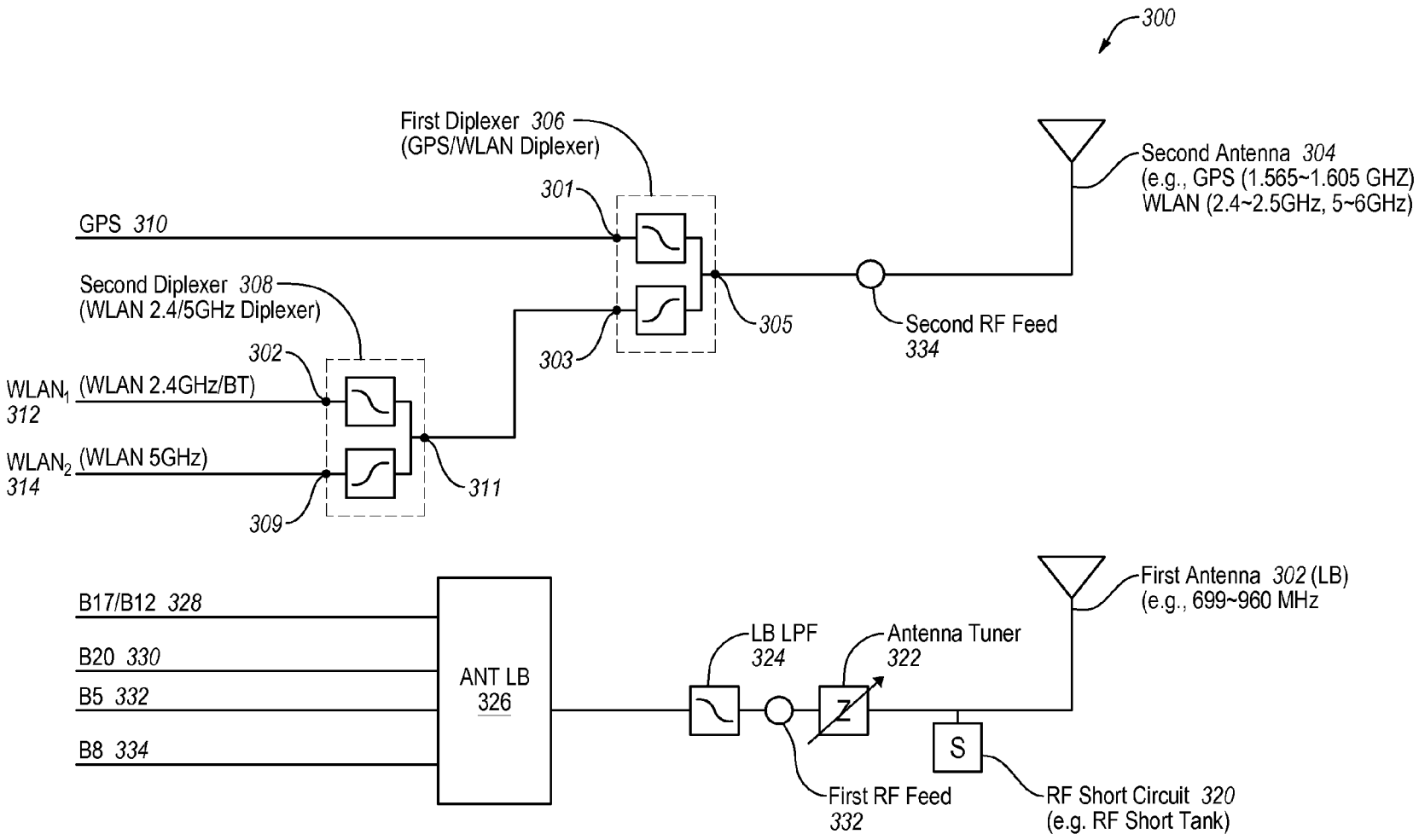
FIG. 3 is a block diagram of a co-located, multi-element antenna structure according to one embodiment.

FIG. 3 is a block diagram of a co-located, multi-element antenna structure 300 according to one embodiment. The co-located, multi-element antenna structure 300 (hereinafter "antenna structure 300") includes a first antenna 302 (LB) (e.g., approximately 699 MHz to approximately 960 MHz) a second antenna 304 (GPS (e.g., approximately 1.565 GHz to approximately 1.605 GHz), dual-band WLAN (e.g., approximately 2.4 GHz to approximately 2.5 GHz and approximately 5 GHz to approximately 6 GHz) and a RF short circuit 320 (e.g., RF short tank). The antenna structure 300 also include a first diplexer 306 including a first port 301 coupled to a GPS receiver 319, a second port 303 coupled to a third port of a second diplexer 308, and a third port 305 coupled to the second antenna 304. The second diplexer 308 includes a first port 307 coupled to a first WLAN transceiver 312, a second port coupled to a second WLAN transceiver 314, and the third port 311 coupled to the second port of the first diplexer 306. Diplexers, as used herein, are passive devices that implement frequency domain multiplexing. A diplexer includes first and second ports (e.g., L and H) that are multiplexed on a third port (e.g., S). The signals on the first and second ports occupy disjoint frequency bands. Consequently, the signals on the first port and second port can coexist on the third port without interfering with each other. The second antenna 304 transmits or receives GPS signals and WLAN signals. The first diplexer 306 separates the GPS signals for the GPS receiver from the WLAN signals. The second diplexer 308 separates the WLAN signals in a first WLAN frequency band (e.g., 2.4 GHz) for the first WLAN transceiver 312 from the WLAN signals in a second WLAN frequency band (e.g., 5 GHz) for the second WLAN transceiver 314.

The RF short circuit 320 is coupled in parallel to the ground plane. In a further embodiment, the antenna structure 300 includes an antenna tuner 322 coupled to the first antenna 302 and a low-band low pass filter 324 (LPF) coupled between the antenna tuner 322 and one or more WAN channels of a WAN transceiver via a front-end LB circuit 326. For example, the front-end LB circuit can coupled to a wireless transceiver for bands 17 and 12 (B17 and B12) 328, band 20 (B20) 330, band 5 (B5) 332 and band eight (B8) 334. The antenna tuner 322 can be used to tune the first antenna 302 to operate in various frequency bands, as illustrated in the exemplary equivalent circuits of FIG. 5. These WAN frequency bands are merely exemplary bands that can be supported by the first antenna 302. Alternatively, the first antenna 302 can support other frequency bands in the low-band.

In one embodiment, the RF short circuit 320 includes three conductive paths coupled in parallel between a first RF feed 342 and a ground plane (not illustrated in FIG. 3). In another embodiment, the RF short circuit 320 includes transmission lines for the three conductive paths to operate as RF shorts at three different frequencies as tuned by the characteristics of the transmission lines. In another embodiment, the RF short circuit 320 is a RF short tank, including one or more inductive-capacitive (LC) elements coupled in parallel between the first RF feed 342 and the ground plane. Each of the conductive paths with LC elements operates as a RF short at three different frequencies as tuned by the characteristics of the LC elements. For example, a first one of the three conductive paths (transmission line or LC element path) can be tuned to operate as a first RF short at approximately 1.575 GHz, a second one of the three conductive paths operates as a second RF short at approximately 2.45 GHz, and a third one of the three conductive paths operates as a third RF short at approximately 5.5 GHz. Of course, the RF shorts can be tuned to other frequencies than these three. Also, more conductive paths can be added to cause the first RF feed 342 to operate as a RF short in additional frequencies of the second antenna 304.

Figure 4:
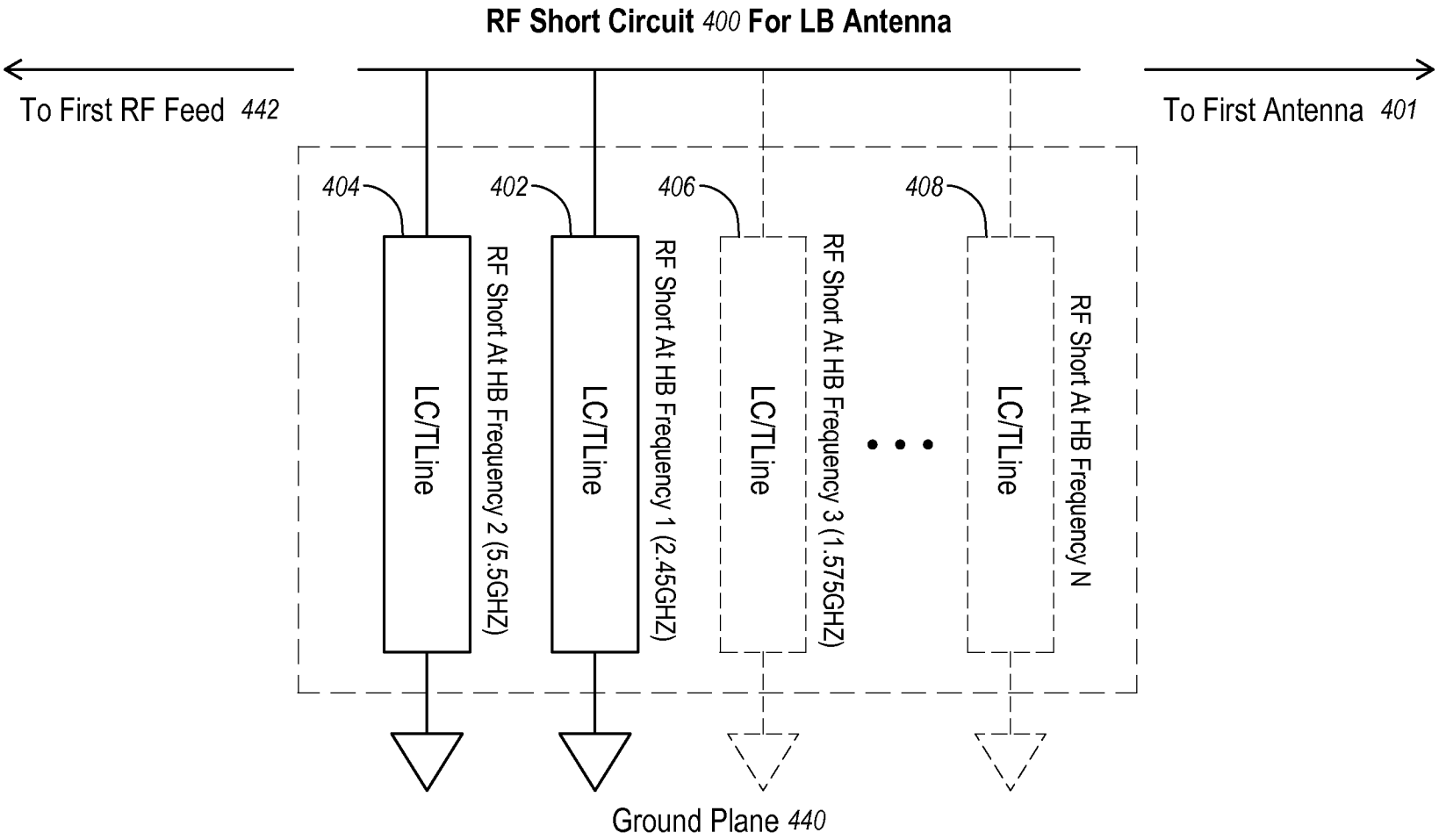
FIG. 4 illustrates a RF short circuit according to one embodiment.

FIG. 4 illustrates a RF short circuit 400 according to one embodiment. The RF short circuit 400 for a LB antenna includes multiple conductive paths 402-408, including either a transmission line or LC elements to operate as RF shorts at multiple frequencies. The RF short circuit 400 grounds the first antenna (LB feed) when the second antenna is driven (HB feed) in one or more frequencies. The RF short circuit 400 grounds the first RF feed 442 when RF signals in a second frequency range are applied to the second RF feed 344 (not illustrated in FIG. 4). The RF short circuit 400 provides a signal path to ground for the RF signals in the second frequency range at the first RF feed 442. The conductive path 402 operates as an RF short at a first HB frequency (e.g., 2.45 GHz), the conductive path operates as an RF short at a second HB frequency (e.g., 5.5 GHz), and the conductive path 406 operates as an RF short at a third HB frequency (e.g., 1.575 GHz). In other embodiments, additional conductive paths may be added, such as illustrated by the conductive path 408. The Nth conductive path can operate as a RF short at an N frequency. The conductive paths 402-408 are coupled between a node coupled to a first antenna 401 and a ground plane 440. The node is located between a first RF feed 442 and the first antenna 401. The conductive paths 402-408 can be transmission lines coupled in parallel between the first RF feed 442 and the ground plane 440, where each transmission line operates as a RF short at a specified frequency within the second frequency range of a second antenna (not illustrated in FIG. 4). In another embodiment, the RF short circuit 400 is a RF short tank including multiple LC elements coupled in parallel between the first RF feed 442 and the ground plane 440, each of the LC elements operates as an RF short at a specified frequency range of the second antenna.

Figure 5:
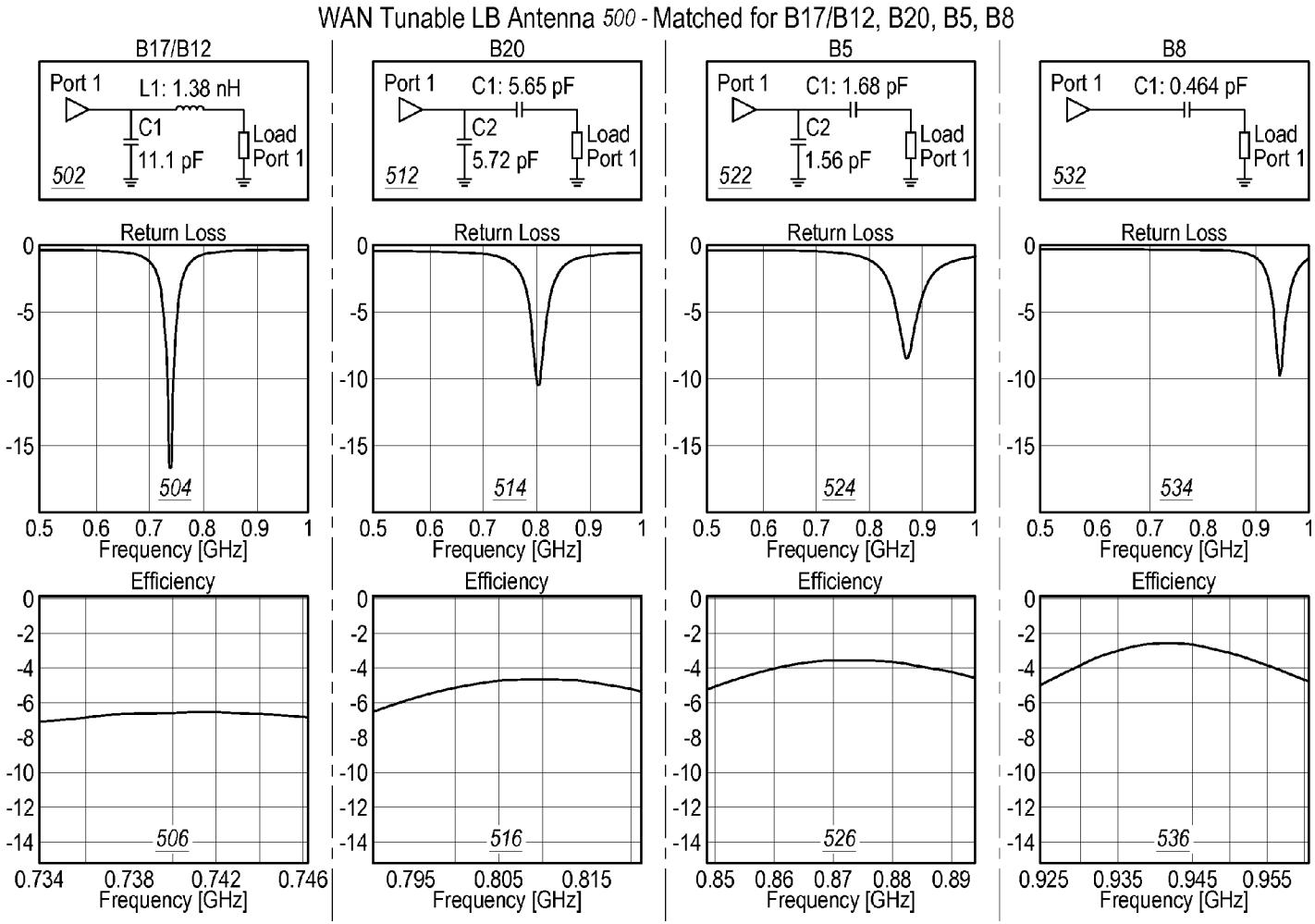
FIG. 5 illustrates an equivalent circuit, return loss and efficiency for a wide area network (WAN) antenna matched for multiple frequency bands in a low-band according to various embodiments.

FIG. 5 illustrates an equivalent circuit, return loss and efficiency for a wide area network (WAN) tunable LB antenna 500 matched for multiple frequency bands in a low-band according to various embodiments. The WAN tunable LB antenna 500 is a tunable antenna. For example, the WAN tunable LB antenna 500 can include the antenna tuner 322 of FIG. 3 to tune the WAN tunable LB antenna 500 to operate in various frequency bands, as represented by the following exemplary equivalent circuits. The equivalent circuit 502 of the WAN tunable LB antenna 500 can include a capacitance in parallel to the load and an inductance in series with the load, the capacitance and inductance being tuned for B17/B12 bands. The corresponding graphs below the equivalent circuit 502 shows a return loss 504 and efficiency 506 of the equivalent circuit 502. Return loss 504, which can also be represented as the S-parameter or measured reflection coefficient or |S11|, is tuned to be centered at approximately 740 MHz. As would be appreciated by one of ordinary skill in the art having the benefit of this disclosure the total efficiency of the antenna can be measured by including the loss of the structure (e.g., due to mismatch loss), dielectric loss, and radiation loss. The efficiency of the antenna can be tuned for specified target bands. The efficiency of the co-located, multi-element antenna structure may be modified by adjusting dimensions of the 3D structure, the gaps between the elements of the antenna structure, or any combination thereof. Similarly, 2D structures can be modified in dimensions and gaps between elements to improve the efficiency in certain frequency bands as would be appreciated by one of ordinary skill in the art having the benefit of this disclosure.

The equivalent circuit 512 of the WAN tunable LB antenna 500 can include a first capacitance in parallel to the load and a second capacitance in series with the load, the first and second capacitances being tuned for B20 band. The corresponding graphs below the equivalent circuit 512 shows a return loss 514 and efficiency 516 of the equivalent circuit 512. Return loss 514 is tuned to be centered at approximately 810 MHz.

The equivalent circuit 522 of the WAN tunable LB antenna 500 can include a first capacitance in parallel to the load and a second capacitance in series with the load, the first and second capacitances being tuned for B5 band. The corresponding graphs below the equivalent circuit 522 shows a return loss 524 and efficiency 526 of the equivalent circuit 522. Return loss 524 is tuned to be centered at approximately 870 MHz.

The equivalent circuit 532 of the WAN tunable LB antenna 500 can include a capacitance in series with the load, the capacitance being tuned for B8 band. The corresponding graphs below the equivalent circuit 532 shows a return loss 534 and efficiency 536 of the equivalent circuit 532. Return loss 534 is tuned to be centered at approximately 940 MHz.

Figure 6:
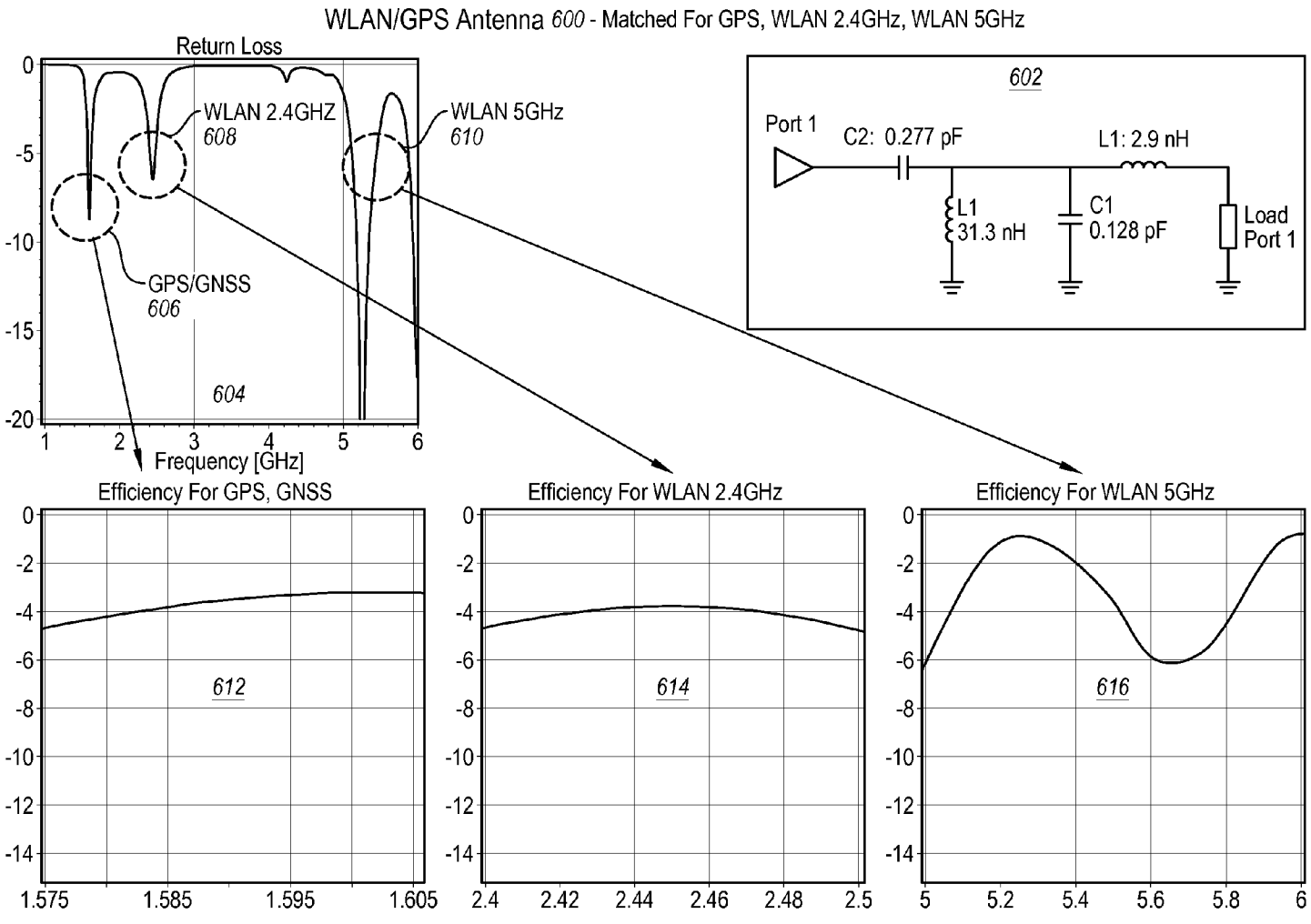
FIG. 6 illustrates an equivalent circuit, return loss and efficiency for a dual-band wireless local area network (WLAN) and global positioning system (GPS) antenna matched for multiple frequency bands in a high-band according to various embodiments.

FIG. 6 illustrates an equivalent circuit, return loss and efficiency for a dual-band wireless local area network (WLAN) and global positioning system (GPS) antenna matched for multiple frequency bands in a high-band according to various embodiments. The equivalent circuit 602 of the WLAN/GPS antenna 600 can include a first capacitance and a first inductive in series with the load and a second capacitance and a second inductance in parallel to the load, the capacitances and inductances being tunable to match multiple frequency bands, such as frequency band 606 (e.g., GPS band or global navigation satellite system (GNSS) band), frequency band 608 (e.g., 2.4 GHz band), and frequency band 610 (e.g., 5 GHz band). The corresponding graphs of the equivalent circuit 502 show a return loss 604 and efficiencies 612, 614, and 616 for the frequency bands 606, 608, and 610, respectively. Return loss 604 is tuned to be centered at approximately 1.575 MHz for GPS, 2.4 GHz and 5 GHz for dual-band Wi-Fi® frequency bands.

Figure 7:
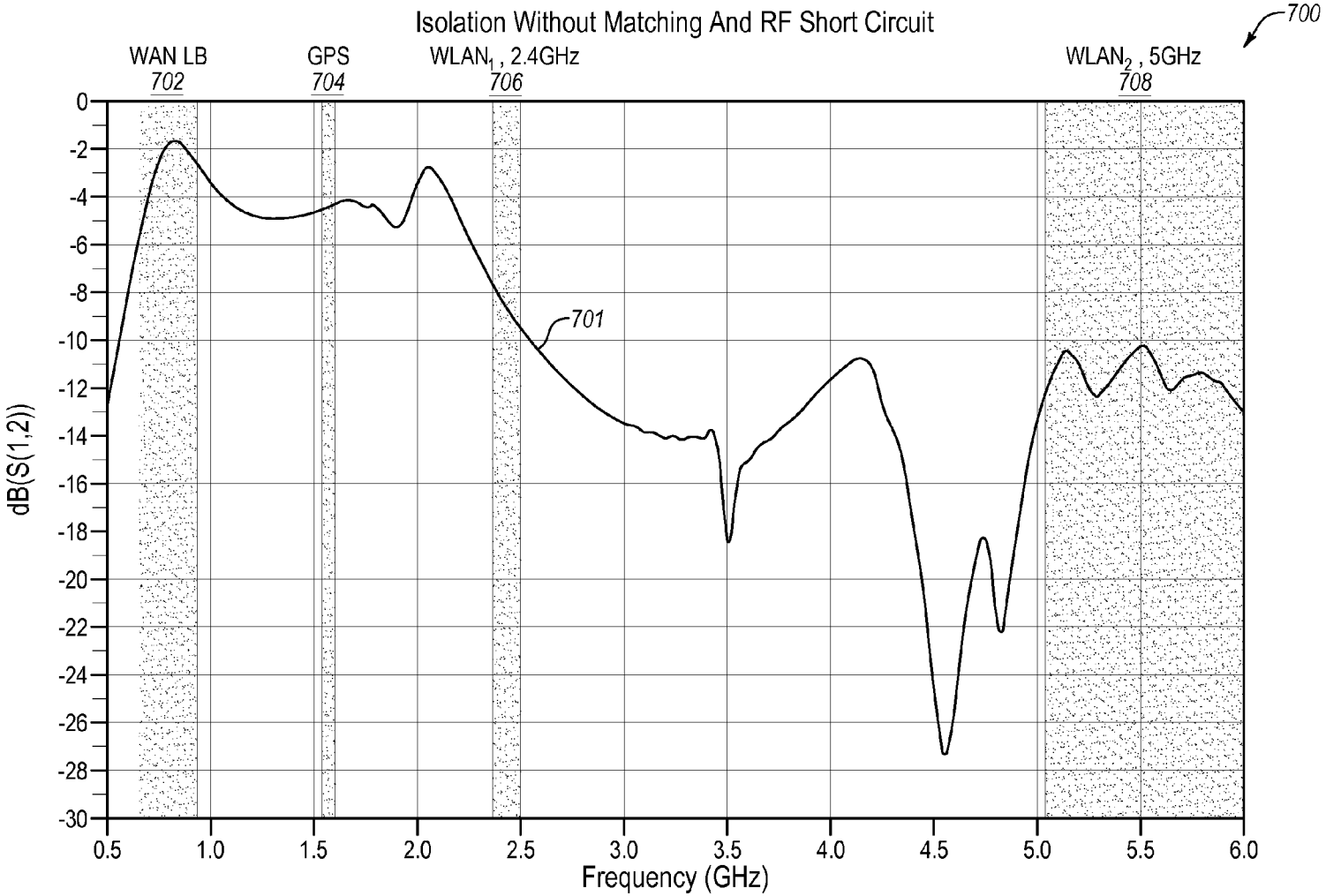
FIG. 7 is a graph illustrating isolation between a first antenna element and a second antenna element of the co-located, multi-element antenna structure without matching and a RF short circuit according to one embodiment.

FIG. 7 is a graph 700 illustrating isolation between a first antenna element and a second antenna element of the co-located, multi-element antenna structure without matching and a RF short circuit according to one embodiment. Isolation 701 can be measured with a network analyzer that sweeps form a lowest transmit frequency to a highest receive frequency. In particular, the network analyzer is setup in a way whereby a transmit port (S1) is on a transmitting antenna and a receive port (S2) is on the other antenna. Isolation 701 can be measured or simulated from the actual losses for both transmitting antenna and receiving antenna. FIG. 7 illustrates the isolation over the WAN LB 702, GPS 704, $WLAN_1$ 706 and $WLAN_2$ 708 frequency bands. As illustrated in FIG. 7, the co-located, multi-element antenna structure without matching and RF shorts at the first RF feed may result in unacceptable isolation in certain frequency ranges, such as WAN LB 702 and GPS 704. Alternatively, isolation techniques may be used for these frequency ranges.

Figure 8:
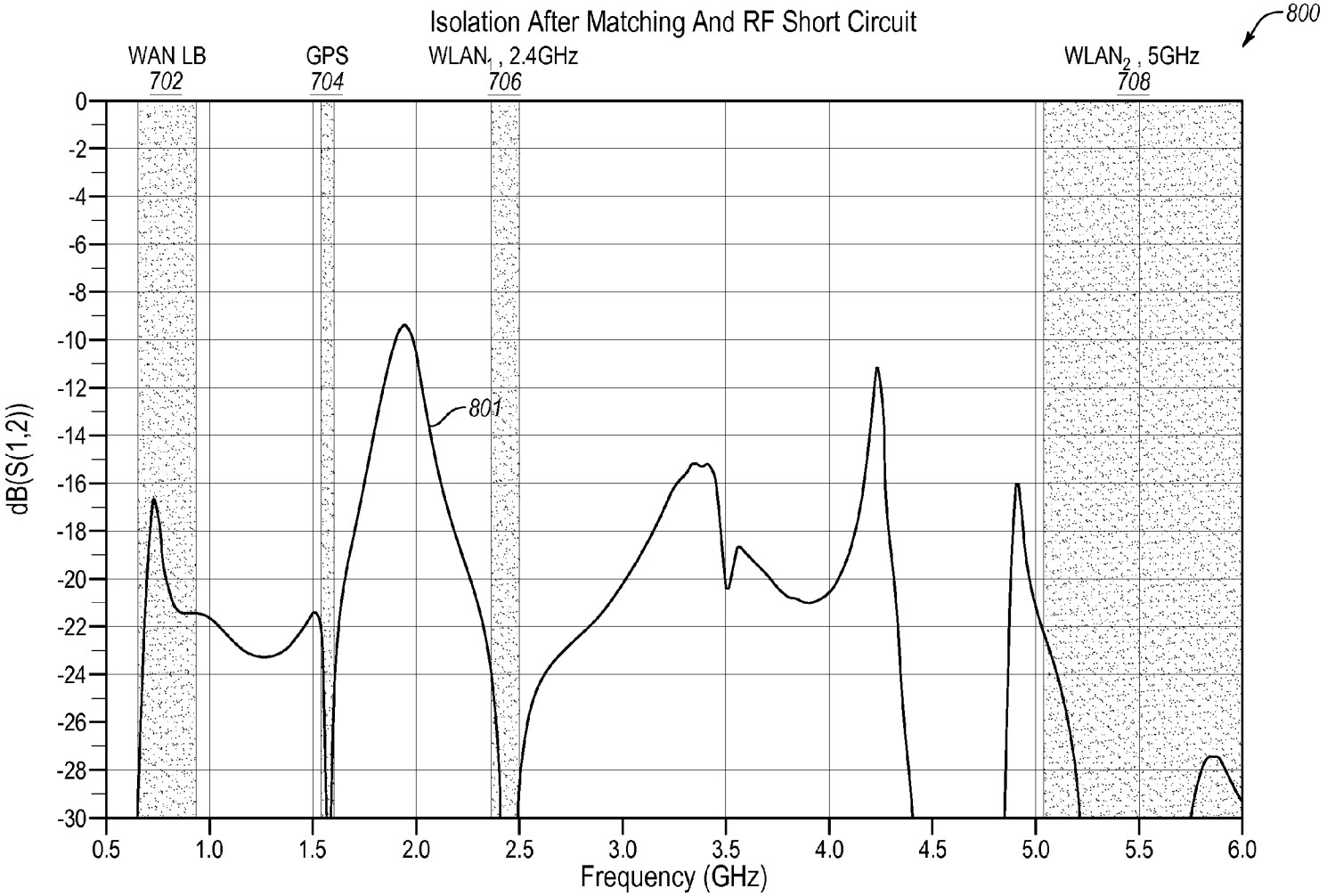
FIG. 8 is a graph illustrating isolation between a first antenna element and a second antenna element of the co-located, multi-element antenna structure with matching and a RF short circuit according to another embodiment.
Figure 9:
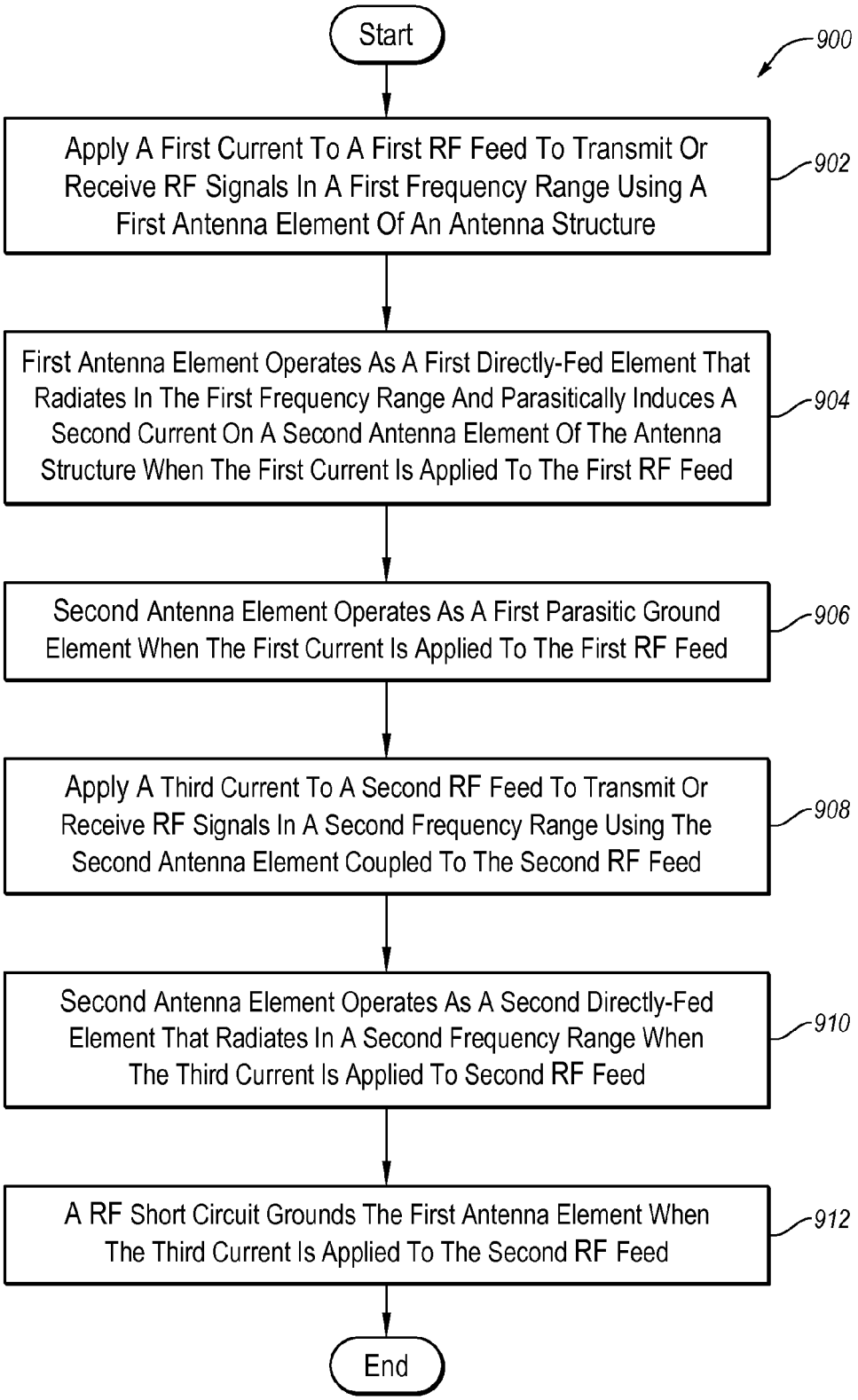
FIG. 9 is a flow diagram of an embodiment of a method of operating a user device having a co-located, multi-element antenna structure according to one embodiment.

FIG. 8 is a graph 800 illustrating isolation between a first antenna element and a second antenna element of the co-located, multi-element antenna structure with matching and a RF short circuit according to another embodiment. Isolation 801 can be measured with a network analyzer in a similar manner. Isolation 801 can be measured or simulated from the actual losses for both transmitting antenna and receiving antenna. FIG. 8 illustrates the isolation over the WAN LB 702, GPS 704, $WLAN_1$ 706 and $WLAN_2$ 708 frequency bands. As illustrated in FIG. 8, the co-located, multi-element antenna structure with matching and RF shorts at the first RF feed may result in better isolation than isolation 701 over one or more frequency ranges between approximately 600 MHz to approximately 6 GHz. The co-located, multi-element antenna structure with matching and RF shorts can provide better isolation specifically WAN LB 702, GPS 704, $WLAN_1$ 706 and $WLAN_2$ 708 frequency bands. FIG. 9 is a flow diagram of an embodiment of a method 900 of operating an electronic device having a co-located, multi-element antenna structure according to one embodiment. In method 900, a first current is applied to a first RF feed to transmit or receive RF signals in a first frequency range using a first antenna element of an antenna structure (block 902). The first antenna element operates as a first directly-fed element that radiates in the first frequency range and parasitically induces a second current on a second antenna element of the antenna structure when the first current is applied to the first RF feed (block 904). The second antenna element operates as a first parasitic ground element when the first current is applied to the first RF feed (block 906). A third current is applied a third current to a second RF feed to transmit or receive RF signals in a second frequency range using the second antenna element coupled to the second RF feed (block 908). The second antenna element operates as a second directly-fed element that radiates in a second frequency range when the third current is applied to second RF feed (block 910). The second frequency range is higher than the first frequency range. A RF short circuit grounds the first antenna element when the third current is applied to the second RF feed (block 912).

In a further embodiment, a fourth current is applied to the second RF feed to transmit or receive RF signals in a third frequency range using a third antenna element of the antenna structure. The third antenna element operates as a second parasitic ground element when the fourth current is applied to the second RF feed.

In a further embodiment, applying the first current causes the antenna structure to radiate electromagnetic energy at the first frequency range between approximately 699 MHz to approximately 960 MHz. Applying the third current causes the antenna structure to radiate electromagnetic energy in at least one of the following: a first sub-range of the second frequency range between approximately 1.565 GHz to approximately 1.605 GHz; a second sub-range of the second frequency range between approximately 2.4 GHz to approximately 2.5 GHz; and a third sub-range of the second frequency range between approximately 5 GHz to approximately 6 GHz. In a further embodiment, the first antenna element is grounded at approximately 1.575 GHz when the third current is applied to the second RF feed to radiate in the first sub-range. The first antenna element is grounded at approximately 2.45 GHz when the third current is applied to the second RF feed to radiate in the second sub-range. The first antenna element is grounded at approximately 5.5 GHz when the third current is applied to the second RF feed to radiate in the third sub-range.

In response to the applied current(s), when applicable, the antenna structure radiates electromagnetic energy to communicate information to one or more other devices. Regardless of the antenna configuration, the electromagnetic energy forms a radiation pattern. The radiation pattern may be various shapes as would be appreciated by one of ordinary skill in the art having the benefit of this disclosure.

In a further embodiment, the antenna structure can be tuned with an antenna tuner coupled between the first antenna element and a WAN transceiver. In a further embodiment, a low pass filter can be coupled between the antenna tuner and the WAN transceiver. Alternatively, the antenna structure can be tuned with one or more other tunable elements.

The antenna structure of the co-located, multi-element antenna structure can provide different resonant modes for various bands, such as a low-band, mid-band, high-band, or any combination thereof. For example, the antenna structure provides two or more resonant modes.

Figure 10:
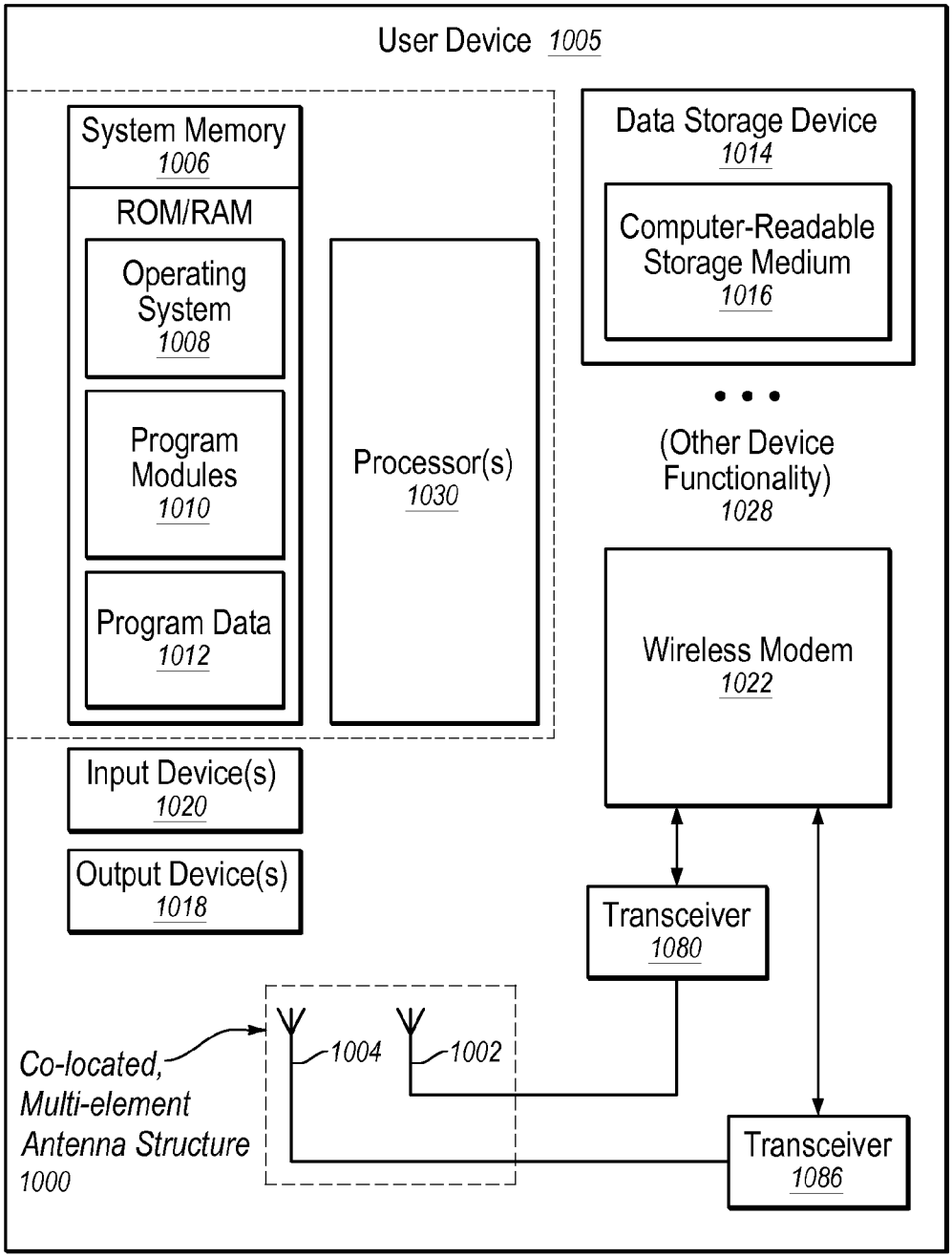
FIG. 10 is a block diagram of a user device in which embodiments of a co-located, multi-element antenna structure may be implemented.

FIG. 10 is a block diagram of a user device 1005 having the co-located, multi-element antenna structure 1000 according to one embodiment. The user device 1005 includes one or more processors 1030, such as one or more CPUs, microcontrollers, field programmable gate arrays, or other types of processing devices. The user device 1005 also includes system memory 1006, which may correspond to any combination of volatile and/or non-volatile storage mechanisms. The system memory 1006 stores information, which provides an operating system component 1008, various program modules 1010, program data 1012, and/or other components. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any one or more of the functions of the user device 1005, as described herein. As shown, instructions may reside, completely or at least partially, within the computer-readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1020 (keyboard, mouse device, specialized selection keys, etc.) and one or more output devices 1018 (displays, printers, audio output mechanisms, etc.).

The user device 1005 further includes a wireless modem 1022 to allow the user device 1005 to communicate via a wireless network (e.g., such as provided by a wireless communication system) with other computing devices, such as remote computers, an item providing system, and so forth. The wireless modem 1022 allows the user device 1005 to handle both voice and non-voice communications (such as communications for text messages, multimedia messages, media downloads, web browsing, etc.) with a wireless communication system. The wireless modem 1022 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WLAN (e.g., Wi-Fi® network), etc. In other embodiments, the wireless modem 1022 may communicate according to different communication types (e.g., WCDMA, GSM, LTE, CDMA, WiMax, etc.) in different cellular networks. The cellular network architecture may include multiple cells, where each cell includes a base station configured to communicate with user devices within the cell. These cells may communicate with the user devices 1005 using the same frequency, different frequencies, same communication type (e.g., WCDMA, GSM, LTE, CDMA, WiMax, etc.), or different communication types. Each of the base stations may be connected to a private, a public network, or both, such as the Internet, a local area network (LAN), a public switched telephone network (PSTN), or the like, to allow the user devices 1005 to communicate with other devices, such as other user devices, server computing systems, telephone devices, or the like. In addition to wirelessly connecting to a wireless communication system, the user device 1005 may also wirelessly connect with other user devices. For example, user device 1005 may form a wireless ad hoc (peer-to-peer) network with another user device.

The wireless modem 1022 may generate signals and send these signals to transceiver 1080 or transceiver 1086 for amplification, after which they are wirelessly transmitted via the co-located, multi-element antenna structure 1000, including first antenna element 1002 and second antenna element 1004. Although FIG. 10 illustrates transceivers 1080, 1086, in other embodiments, a power amplifier (power amp) may be used for any one or both of the first and second antenna elements 1002, 1004 to transmit and receive. Or, receivers may be used instead of transceivers, such as a GPS receiver. The co-located, multi-element antenna structure 1000 may be any directional, omnidirectional or non-directional antenna in a different frequency band. The first antenna element 1002 and second antenna element 1004 may also transmit information using different wireless communication protocols than each other. In addition to sending data, the co-located, multi-element antenna structure 1000 also can receive data, which is sent to wireless modem 1022 and transferred to processor(s) 1030. It should be noted that, in other embodiments, the user device 1005 may include more or less components as illustrated in the block diagram of FIG. 10. In one embodiment, the co-located, multi-element antenna structure 1000 is the antenna structure 100 of FIG. 1. In another embodiment, the co-located, multi-element antenna structure 1000 is the antenna structure 300 of FIG. 3. Alternatively, the co-located, multi-element antenna structure 1000 may be other variants of the co-located, multi-element antenna structures as described herein.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WLAN hotspot and a connection to a wireless carrier system. In one embodiment, the first wireless connection is associated with a first resonant mode of the co-located, multi-element antenna structure 1000 that operates at a first frequency band and the second wireless connection is associated with a second resonant mode of the co-located, multi-element antenna structure 1000 that operates at a second frequency band. In another embodiment, the first wireless connection is associated with the first antenna element 1002 of the co-located, multi-element antenna structure 1000 and the second wireless connection is associated with the second antenna element 1004. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a wireless modem 1022 is shown to control transmission to both antenna elements 1002 and 1004, the user device 1005 may alternatively include multiple wireless modems, each of which is configured to transmit/receive data via a different antenna and/or wireless transmission protocol. In addition, the user device 1005, while illustrated with two antenna elements 1002 and 1004, may include more or fewer antennas in various embodiments. For example, a third antenna element, as described herein, can be used in connection with the first antenna element 1002 and second antenna element 1004.

The user device 1005 delivers and/or receives items, upgrades, and/or other information via the network. For example, the user device 1005 may download or receive items from an item providing system. The item providing system receives various requests, instructions and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless local area network (WLAN) hotspot connected with the network. The WLAN hotspots can be created by Wi-Fi® products based on IEEE 802.11x standards by Wi-Fi Alliance. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An electronic device comprising:

a first radio frequency (RF) feed;

a second RF feed;

a RF short circuit, wherein the RF short circuit provides a signal path to ground for RF signals applied to the second RF feed; and a multi-element antenna structure coupled to the first RF feed and the second RF feed, wherein the multi-element antenna structure comprises a coupling section in which at least portions of the multi-element antenna structure are disposed on a same plane and proximate to one another, wherein the multi-element antenna structure comprises:

a ground plane;

a first antenna element coupled to the first RF feed, wherein the first antenna element extends from the first RF feed towards the second RF feed, wherein the RF short circuit is disposed at a proximal end of the first antenna element near the first RF feed, wherein a distal end of the first antenna element is not coupled to the ground plane; and a second antenna element coupled to the second RF feed, wherein a distal end of the second antenna element is directly coupled to the ground plane at a first grounding point, wherein the first RF feed is located to one side of the second RF feed and the first grounding point is located on an opposite side of the second RF feed, wherein the first antenna element and the second antenna element collectively radiate electromagnetic energy in a first frequency range when RF signals are applied to the first RF feed, the RF signals at the first RF feed causing a first current flow between the first RF feed and the first grounding point through the coupling section, and wherein the second antenna element radiates electromagnetic energy in a second frequency range when RF signals are applied to the second RF feed, the RF signals at the second RF feed causing a second current flow on the second antenna element.

2. The electronic device of claim 1, wherein the first antenna element has an L-shape with a first base portion that extends from the first RF feed to a first junction in a first direction and the first portion that extends from the first junction in a second direction, wherein the second antenna element has a T-shape comprising:

a second base portion that extends from the second RF feed to a second junction in the first direction;

a second portion that extends from the second base portion in a third direction;

a third portion that extends from the second junction in the second direction towards a third junction; and a fourth portion that extends from the third junction to the first grounding point in a fourth direction, wherein the second direction and the third direction are perpendicular to the first direction, and the fourth direction is parallel to the first direction.

3. The electronic device of claim 1, wherein the multi-element antenna structure comprises a third antenna element coupled to the ground plane at a second grounding point, wherein the third antenna element is a parasitic ground element, wherein portions of the first antenna element and the second antenna element collectively radiate electromagnetic energy in a first resonant mode when the RF signals are applied to the first RF feed, and wherein the second antenna element and third antenna element collectively radiate electromagnetic energy in at least two resonant modes when the RF signals are applied to the second RF feed.

4. The electronic device of claim 3, wherein the first frequency range is between approximately 699 MHz to approximately 960 MHz and the second frequency range comprises:

a first sub-range between approximately 1.565 GHz to approximately 1.605 GHz;

a second sub-range between approximately 2.4 GHz to approximately 2.5 GHz; and a third sub-range between approximately 5 GHz to approximately 6 GHz.

5. The electronic device of claim 1, wherein the second antenna element operates as a second parasitic ground element when the RF signals are applied to the first RF feed, wherein the second antenna element operates as a directly-fed element when the RF signals are applied to the second RF feed, wherein the RF short circuit comprises a RF short tank to ground the first RF feed when the RF signals are applied to second RF feed, wherein the RF short tank comprises one or more inductive-capacitive (LC) elements coupled in parallel between the first RF feed and the ground plane to provide the signal path to ground for the RF signals applied to the second RF feed.

6. An apparatus comprising:

a first radio frequency (RF) feed;

a RF short circuit coupled to the first RF feed;

a second RF feed; and an antenna structure comprising:

a ground plane;

a first antenna element coupled to the first RF feed and coupled to the RF short circuit at a proximal end of the first antenna element near the first RF feed, wherein a distal end of the first antenna element is not coupled to the ground plane;

a second antenna element coupled to the second RF feed and directly coupled to the ground plane at a first grounding point located at a first end of the second antenna element, wherein the first RF feed is located to one side of the second RF feed and the first grounding point is located on an opposite side of the second RF feed; and a coupling section comprising a portion of the first antenna element that is disposed to be in parallel to a portion of the second antenna element, wherein the first antenna element and the second antenna element collectively radiate electromagnetic energy in a first frequency when RF signals are applied to the first RF feed, the RF signals at the first RF feed causing a first current flow between the first RF feed and the first grounding point through the coupling section, wherein the second antenna element radiates electromagnetic energy in a second frequency when RF signals are applied to the second RF feed, and wherein the first antenna element is grounded by the RF short circuit when the RF signals are applied to the second RF feed, the RF signals at the second RF feed causing a second current flow between the second RF feed and the first grounding point and a third current flow between the second RF feed and the portion of the second antenna element of the coupling section.

7. The apparatus of claim 6, wherein the antenna structure further comprises a third antenna element coupled to the ground plane at a second grounding point.

8. The apparatus of claim 6, wherein the first antenna element extends from the first RF feed towards the second RF feed, wherein the first antenna element is not conductively coupled to the second RF feed, wherein the portion of the first antenna element extends from the first RF feed towards the second RF feed and is not conductively coupled to the portion of the second antenna element.

9. An apparatus comprising:

a first radio frequency (RF) feed;

a RF short circuit coupled to the first RF feed;

a second RF feed; and an antenna structure comprising:

a ground plane;

a first antenna element coupled to the first RF feed at a proximal end of the first antenna element, wherein a distal end of the first antenna element is not coupled to the ground plane; and a second antenna element coupled to the second RF feed and directly coupled to the ground plane at a first grounding point located at a distal end of the second antenna element, wherein the first RF feed is located to one side of the second RF feed and the first grounding point is located on an opposite side of the second RF feed, wherein the first antenna element operates as a first directly-fed element and the second antenna element operates as a first parasitic ground element when RF signals in a first frequency range are applied to the first RF feed, wherein the second antenna element operates as a second directly-fed element when RF signals in a second frequency range are applied to the second RF feed, the second frequency range being higher than the first frequency range, wherein the first antenna element is grounded by the RF short circuit when the RF signals in the second frequency range are applied to the second RF feed, wherein the first antenna element has an L-shape with a first base portion that extends from the first RF feed to a first junction in a first direction and a first portion that extends from the junction in a second direction, and wherein the second antenna element has a T-shape comprising:

a second base portion that extends from the second RF feed to a second junction in the first direction, a third portion that extends from the second junction in the second direction towards a third junction; and a fourth portion that extends from the third junction to the first grounding point in a fourth direction, wherein the second direction is perpendicular to the first direction, and the fourth direction is parallel to the first direction.

10. The apparatus of claim 6, wherein the antenna structure further comprises a third antenna element coupled to the ground plane at a second grounding point, wherein the antenna structure radiates electromagnetic energy in a plurality of resonant modes, wherein the first antenna element and the second antenna element collectively radiate electromagnetic energy in a first resonant mode of the plurality of resonant modes when the RF signals are applied to the first RF feed, wherein the second antenna element and third antenna element collectively radiate electromagnetic energy in at least two resonant modes of the plurality of resonant modes when the RF signals are applied to the second RF feed.

11. The apparatus of claim 9, wherein the first frequency range is between approximately 699 MHz to approximately 960 MHz and the second frequency range comprises:

a first sub-range between approximately 1.565 GHz to approximately 1.605 GHz;

a second sub-range between approximately 2.4 GHz to approximately 2.5 GHz; and a third sub-range between approximately 5 GHz to approximately 6 GHz.

12. The apparatus of claim 11, wherein the RF short circuit comprises three conductive paths coupled in parallel between the first RF feed and the ground plane, wherein a first one of the three conductive paths operates as a first RF short at approximately 1.575 GHz, wherein a second one of the three conductive paths operates as a second RF short at approximately 2.45 GHz, and wherein a third one of the three conductive paths operates as a third RF short at approximately 5.5 GHz.

13. The apparatus of claim 6, wherein the RF short circuit is a RF short tank comprising a plurality of inductive-capacitive (LC) elements coupled in parallel between the first RF feed and the ground plane, wherein each of the plurality of LC elements operates as an RF short at a specified frequency.

14. The apparatus of claim 6, wherein the RF short circuit comprise a plurality of transmission lines coupled in parallel between the first RF feed and the ground plane, wherein each of the transmission lines operates as an RF short at a specified frequency.

15. The apparatus of claim 7, wherein the antenna structure fits within a volume of 5 mm height, 47 mm width and 6 mm depth.

16. The apparatus of claim 7, further comprising:

a first diplexer coupled between the second antenna element and a global positioning system (GPS) receiver, wherein the second antenna is to transmit or receive GPS signals and wireless area network (WLAN) signals, wherein the first diplexer separates the GPS signals for the GPS receiver from the WLAN signals;

a second diplexer coupled between the first diplexer and a first WLAN transceiver and a second WLAN transceiver, wherein the second diplexer separates the WLAN signals in a first WLAN frequency band for the first WLAN transceiver from the WLAN signals in a second WLAN frequency band for the second WLAN transceiver;

an antenna tuner coupled to the first antenna element, wherein the RF short circuit is coupled in parallel between the antenna tuner and the ground plane; and a low pass filter coupled between the antenna tuner and a wide area network (WAN) transceiver.

17. The electronic device of claim 1, wherein the coupling section comprises a first portion of the first antenna element and a second portion of the second antenna element, wherein the first portion is disposed to be parallel to the second portion of the second antenna element in the coupling section to closely couple the first antenna element and the second antenna element.

18. The electronic device of claim 1, wherein the multi-element antenna structure comprises a third antenna element coupled to the ground plane at a second grounding point.

19. The apparatus of claim 6, wherein the first antenna element operates as a first directly-fed element and the second antenna element operates as a first parasitic ground element when the RF signals are applied to the first RF feed, and wherein the second antenna element operates as a second directly-fed element when the RF signals are applied to the second RF feed, the second frequency being higher than the first frequency.

20. The apparatus of claim 7, wherein the first antenna element operates as a first directly-fed element and the second antenna element operates as a first parasitic ground element when the RF signals are applied to the first RF feed, wherein the second antenna element operates as a second directly-fed element when the RF signals are applied to the second RF feed, the second frequency being higher than the first frequency, and wherein the third antenna element operates as a second parasitic ground element when RF signals are applied to the second RF feed.

* * * * *